US005263500A

United States Patent [19]

Baldwin et al.

[11] Patent Number: 5,263,500

[45] Date of Patent: Nov. 23, 1993

[54] CIGARETTE AND WRAPPER WITH CONTROLLED PUFF COUNT

[75] Inventors: Sheryl D. Baldwin, Richmond; Rowland W. Dwyer, Glen Allen; Deborah J. Newman, Prince George; Barton Floyd, Chester; Robert M. Rogers; Edward B. Sanders, both of Richmond; Barbro L. Goodman, Colonial Heights, all of Va.

[73] Assignee: Philip Morris Incorporated, New York, N.Y.

[21] Appl. No.: 684,603

[22] Filed: Apr. 12, 1991

[51] Int. Cl.[5] ..... A24D 1/02

[52] U.S. Cl. ..... 131/365; 131/331; 162/139

[58] Field of Search ..... 131/365, 331; 162/139

[56] References Cited

U.S. PATENT DOCUMENTS

| | | | |
|---|---|---|---|
| Re. 23,794 | 3/1954 | Schur et al. . | |
| 2,538,802 | 1/1951 | Schur et al. . | |
| 2,580,609 | 1/1952 | Schur et al. . | |
| 2,580,610 | 1/1952 | Schur et al. . | |
| 2,673,565 | 3/1954 | Schur et al. . | |
| 2,733,720 | 2/1956 | Schur et al. . | |
| 3,805,802 | 4/1974 | Hedge et al. . | |
| 3,885,574 | 5/1975 | Borthwick et al. . | |
| 4,008,723 | 2/1977 | Borthwick et al. . | |
| 4,133,317 | 1/1979 | Briskin . | |
| 4,231,377 | 11/1980 | Cline et al. . | |
| 4,407,308 | 10/1983 | Baker et al. . | |
| 4,420,002 | 12/1983 | Cline . | |
| 4,450,847 | 5/1984 | Owens | 131/365 |
| 4,453,553 | 6/1984 | Cohn . | |
| 4,461,311 | 7/1984 | Mathews et al. . | |
| 4,548,677 | 10/1985 | Scheider et al. . | |
| 4,561,454 | 12/1985 | Guess . | |
| 4,615,345 | 10/1986 | Durocher . | |
| 4,622,983 | 11/1986 | Mathews et al. . | |
| 4,805,644 | 2/1989 | Hampl, Jr. et al. . | |
| 4,881,557 | 11/1989 | Martin . | |
| 4,911,184 | 3/1990 | Case et al. . | |
| 4,915,118 | 4/1990 | Kaufman et al. . | |
| 4,984,589 | 1/1991 | Riedesser | 131/365 |
| 4,998,543 | 3/1991 | Goodman et al. | 131/365 |
| 5,060,674 | 10/1991 | Brown et al. | 131/365 |

FOREIGN PATENT DOCUMENTS

| | | |
|---|---|---|
| 702920 | 2/1965 | Canada . |
| 0402059 | 12/1990 | European Pat. Off. . |
| 59-94700 | 5/1984 | Japan . |
| 1533323 | 11/1978 | United Kingdom . |
| 2136668 | 9/1984 | United Kingdom . |

OTHER PUBLICATIONS

Resnick, et al., Factors Affecting Static Burning Rate, Tobacco Science, vol. 21, pp. 103-107, 1977.

Schur, et al., The Design of Low Yield Cigarettes, Tobacco Science, vol. 4, pp. 69-77, 1960.

Owens, Effect of Cigarette Paper on Smoke Yield and Composition Recent Advances in Tobacco Science, vol. 4, pp. 3-24, 32nd Tobacco Chemists' Research Conference, Oct. 30-Nov. 1, 1978 Montreal, Canada.

*Primary Examiner*—V. Millin
*Assistant Examiner*—J. Doyle
*Attorney, Agent, or Firm*—Marta E. Gross; Loretta A. Miraglia

[57] ABSTRACT

A paper wrapper for a cigarette is prepared using fine particle size calcium carbonate as the mineral filler for the purpose of burn rate, puff count and tar delivery control.

16 Claims, No Drawings

CIGARETTE AND WRAPPER WITH CONTROLLED PUFF COUNT

BACKGROUND OF THE INVENTION

This invention relates to a paper wrapper construction for use in conjunction with a smoking article, such as a cigarette. Specifically, the paper wrapper of the invention alters the characteristics of the smoking article including burn rate, puff count, and tar delivery with the use of fine particle size calcium carbonate as a mineral filler.

Cigarette paper has traditionally been used in the cigarette industry to control a number of properties of the completed cigarette. Such properties include burn rate, puff count, and tar delivery. In virtually all cases, however, changes to the cigarette paper have been restricted to two properties of the paper: paper porosity and level of burn control additive.

The relationship of paper porosity to cigarette performance is well understood by the industry. For instance, as inherent paper porosity is increased, burn rate increases, causing puff count and, therefore, total tar delivery to decrease. In general, the faster the burn rate, the lower the puff count. Tar per puff remains approximately constant. If, however, paper porosity is increased through perforation of the paper (increase in paper permeability), then puff count increases and tar per puff decreases due to air dilution during the puff. Static burn rate, however, remains essentially unchanged.

Level of burn control additive is also used to control puff count and tar delivery. Increasing burn control additive over the range typically used (0.5% to 3% by weight) increases burn rate and therefore decreases puff count and total tar delivery.

Despite the flexibility which can be achieved in cigarette design through the manipulation of paper porosity and level of burn control additive, there are instances when a desired cigarette design cannot be optimally achieved by controlling either of these two paper properties. Many examples are in the area of low delivery cigarettes; however, there are certain examples in the category of full flavor cigarettes as well.

Furthermore, controlling a cigarette's properties by adding burn control additives or changing the paper porosity can cause undesired effects. Using high levels of burn control additive or changing paper porosity may produce an undesired decrease in the subjective impact of the smoking article, including lessened taste. Taste is also often sacrificed if a low tar delivery cigarette is designed with a tobacco blend to lower the tar delivery.

Thus, it would be desirable to provide a paper wrapper for a smoking article that can be used to design a cigarette with a certain burn rate.

It would also be desirable to provide a paper wrapper for a smoking article that can be used to design a cigarette with a certain puff count.

It would further be desirable to provide a paper wrapper for a smoking article that can be used to design a cigarette with a certain tar delivery.

It would further be desirable to provide a paper wrapper for a smoking article that can be used to design a cigarette with certain desired characteristics that does not require high levels of burn control additive or major changes in tobacco blend.

It would further be desirable to provide a paper wrapper for a smoking article that can be used to design a cigarette with certain desired characteristics without excessively diminishing the subjective impact, such as taste, of the smoking article.

SUMMARY OF THE INVENTION

It is therefore an object of this invention to provide a paper wrapper for a smoking article that can be used to design a cigarette with a certain burn rate.

It is another object of this invention to provide a paper wrapper for a smoking article that can be used to design a cigarette with a certain puff count.

It is a further object of this invention to provide a paper wrapper for a smoking article that can be used to design a cigarette with a certain tar delivery.

It is a further object of this invention to provide a paper wrapper for a smoking article that can be used to design a cigarette with certain desired characteristics without requiring high levels of burn control additive or major changes in tobacco blend.

It is a further object of this invention to provide a paper wrapper for a smoking article that can be used to design a cigarette with certain desired characteristics without excessively diminishing the subjective impact of the smoking article.

In accordance with this invention there is provided a paper wrapper for a smoking article, such as a cigarette, that uses calcium carbonate, or chalk, particle size to produce changes in burn rate, puff count, and tar delivery of the cigarette. Fine particle size calcium carbonate accelerates burn rate, lowers puff count, and decreases tar, the degree of each effect depending on such things as the particular cigarette design and cigarette blend used. These characteristics of a cigarette can be changed by varying the calcium carbonate particle size with or without changing porosity or burn control additive levels in the paper, or filter characteristics or tobacco blend in the cigarette. Making these changes in the cigarette wrapper characteristics allows the design of desired cigarettes without the use of excessively high levels of burn control additives. This invention also makes it possible to achieve cigarette designs which would not be possible through variations of paper porosity, burn control additive, and filter characteristics alone. Specific designs of smoking articles can be achieved with this invention while improving, or not excessively diminishing, the subjective impact of the smoking article.

The paper wrapper of this invention may be used for cigarettes of any length or circumference. Cigarettes made with the paper wrapper of this invention may have different fillers such as tobacco, expanded tobacco, a variety of blend types, reconstituted tobacco materials, stems, non-tobacco filler materials, and combinations thereof. The paper wrapper of this invention is especially suited for use with expanded tobacco fillers because there is no need for excessively high levels of burn control additives.

DETAILED DESCRIPTION OF THE INVENTION

The paper wrapper of this invention may be made from flax or other cellulosic fibers. Calcium carbonate is used as a filler. The mean particle size of the calcium carbonate should be between about 0.02 microns and 1 micron. Preferably the mean particle size should be between about 0.02 microns and about 0.1 microns, and most preferably should be about 0.07 microns. A typical commercial brand of calcium carbonate having the 0.07 particle size is known by the brand name MULTIFEX MM, available from Pfizer Minerals, Pigments, and Metals Division of Pfizer, Inc., New York, N.Y. and is substantially spherical. Mixtures of calcium carbonate types with differing particle sizes may also be advantageous. For example, mixtures may be used incorporating between about 5% by weight and about 15% by weight of larger particle size calcium carbonate, such as ALBACAR ® (the brand name for calcium carbonate with the standard particle size of between about 2 microns and about 3 microns, available from Pfizer Minerals, Pigments, and Metals Division of Pfizer, Inc., New York, N.Y.), with smaller particle size calcium carbonate, such as Multifex MM TM . Other mixtures may also be used and are not limited to the combination and range of this example.

Between about 20% by weight and about 40% by weight of calcium carbonate is used as a filler. Preferably between about 25% by weight and about 35% by weight of calcium carbonate is used.

The paper wrapper should also have a basis weight of between about 18 g/m$^2$ and about 39 g/m$^2$. Preferably, the basis weight should be about 30 g/m$^2$. It is desireable to have increased basis weight when using MULTIFEX MM TM calcium carbonate in high porosity ranges because this imparts improved tensile properties to the paper.

The inherent porosity of the paper wrapper should be between about 5 Coresta units and about 50 Coresta units. A porosity of between about 20 Coresta units and about 35 Coresta units is preferable for a conventional blend cigarette. A high inherent porosity of between about 40 Coresta units and about 50 Coresta units may be preferable for other applications, such as cigarettes designed for low tar delivery. In addition, a low inherent porosity of between about 5 Coresta units and about 20 Coresta units may be preferable for cigarettes with a high level of expanded tobacco having puff counts of 7.5 or more.

The paper may also be treated with low to moderate levels (between about 0.5% by weight and about 3% by weight, preferably between about 1% by weight and about 1.7% by weight) of a burn control additive. Such a burn control additive is an alkali metal salt, preferably a citrate such as potassium citrate. Acetates or various phosphate salts, such as monopotassium phosphate, monoammonium phosphate or mixtures thereof, may also be used. One purpose of the burn control additive is to control puff count. The optimum level of burn control additive depends on the specific characteristics of the paper wrapper and other details of the cigarette design.

A particular example of such a paper wrapper uses calcium carbonate with a particle size of about 0.07 microns. The paper wrapper also has a calcium carbonate filler loading of between about 33% by weight and about 36% by weight, a paper porosity of 30 Coresta units, a burn control additive level of 1.7% by weight, and a paper basis weight of 30 g/m$^2$.

EXAMPLE 1

Cigarettes were made from paper wrappers having about 25% by weight MULTIFEX MM TM calcium carbonate filler with a mean particle size of 0.07 microns. A control was used having about 25% by weight ALBACAR ® calcium carbonate filler, with a mean particle size of 2 microns. The paper wrappers had a basis weight of 25 g/m$^2$, inherent porosity of between 33 Coresta units and 38 Coresta units, and a burn control additive level of between 2.8% by weight and 3.1% by weight citrate. Evaluation showed a decrease in puff count for the finer (0.07 micron) particle size calcium carbonate, as seen in Table 1.

TABLE 1

Effect of Calcium Carbonate Particle Size on Puff Count

| | 0.07 micron | 2 micron |
|---|---|---|
| Puff Count | 7.0 | 7.5 |

EXAMPLE 2

Cigarettes were prepared with paper wrappers containing MULTIFEX MM TM calcium carbonate (0.07 microns) and ALBACAR ® calcium carbonate (2 microns). The calcium carbonate loading level was 35% by weight. The paper wrappers had a basis weight of 46 g/m$^2$ and an inherent porosity of 8 Coresta units. Monoammonium phosphate was used as a burn control additive at 0.5% by weight. A conventional blend of tobacco filler was used in the cigarette. Evaluation showed a lower puff count and reduced tar delivery with the fine particle size (0.07 micron) calcium carbonate, as seen in Table 2.

TABLE 2

Effect of Calcium Carbonate Size on Puff Count and Tar Delivery

| | 0.07 micron | 2 micron |
|---|---|---|
| Puff Count | 7.4 | 8.5 |
| Tar, mg | 18.8 | 23.1 |

EXAMPLE 3

Cigarettes were prepared with paper wrappers containing MULTIFEX MM TM calcium carbonate (0.07 microns) and ALBACAR ® calcium carbonate (2 microns). The calcium carbonate loading level was 29% by weight. The paper wrappers had a basis weight of 25 g/m$^2$ and an inherent porosity of 13 Coresta units. Monoammonium phosphate was used as a burn control additive at 0.8% by weight. A conventional blend of tobacco filler was used in the cigarette. Evaluation showed a lower puff count and reduced tar delivery with the fine particle size (0.07 micron) calcium carbonate, as seen in Table 3.

TABLE 3

Effect of Calcium Carbonate Particle Size on Puff Count and Tar Delivery

| | 0.07 micron | 2 micron |
|---|---|---|
| Puff Count | 9.0 | 9.9 |
| Tar, mg | 21.3 | 22.3 |

These three examples were all taken from statistical studies evaluating the effects described herein. The statistical studies supported the findings of these examples.

Thus it is seen that a paper wrapper for a smoking article, such as a cigarette, is provided that allows the design of smoking articles with specific characteristics such as a certain burn rate, puff count, or tar delivery by changing the particle size of the calcium carbonate of the paper. In addition, calcium carbonate levels, basis weight, porosity, filter ventilation, and filter efficiency can be manipulated to optimize this effect. Particular cigarettes can be designed, then, without using high levels of burn control additive and without making major changes in tobacco blend. This avoids the negative effects on subjectives, such as taste, that high levels of burn control additive and major changes in tobacco blend may have. One skilled in the art will appreciate that the present invention can be practiced by other than the described embodiments, which are presented for purposes of illustration and not of limitation, and the present invention is limited only by the claims that follow.

What is claimed is:

1. A paper wrapper for a smoking article comprising:

a calcium carbonate loading of between about 20% by weight and about 40% by weight, the calcium carbonate being substantially spherical and having a mean particle size of between about 0.02 microns and about 1 micron;

a basis weight of between about 18 $g/m^2$ and about 39 $g/m^2$; and an inherent porosity of between about 5 Coresta units and about 50 Coresta units.

2. The paper wrapper of claim 1 wherein the calcium carbonate has a mean particle size of between about 0.02 microns and about 0.1 microns.

3. The paper wrapper of claim 1 wherein the calcium carbonate loading is between about 25% by weight and about 35% by weight, and the calcium carbonate has a mean particle size of about 0.07 microns; and the basis weight is about 30 $g/m^2$.

4. The paper wrapper of any of claims 1, 2 or 3 wherein the inherent porosity is between about 5 Coresta units and about 20 Coresta units.

5. The paper wrapper of any of claims 1, 2 or 3 wherein the inherent porosity is between about 20 Coresta units and about 35 Coresta units.

6. The paper wrapper of any of claims 1, 2 or 3 wherein the inherent porosity is between about 40 Coresta units and about 50 Coresta units.

7. The paper wrapper of any of claims 1, 2 or 3 further comprising a burn control additive, wherein the burn control additive level is between about 0.5% by weight and about 3% by weight.

8. The paper wrapper of claim 7 wherein the level of burn control additive is between about 1% by weight and about 1.7% by weight.

9. A smoking article comprising a smokeable filler surrounded by a paper wrapper, the paper wrapper having a calcium carbonate loading of between about 20% by weight and about 40% by weight, the calcium carbonate being substantially spherical and having a mean particle size of between about 0.02 microns and about 1 micron;

a basis weight of between about 18 $g/m^2$ and about 39 $g/m^2$; and an inherent porosity of between about 5 Coresta units and about 50 Coresta units.

10. The smoking article of claim 9 wherein the calcium carbonate has a mean particle size of between about 0.02 microns and about 0.1 microns.

11. The smoking article of claim 9 wherein the calcium carbonate loading is between about 25% by weight and about 35% by weight, and the calcium carbonate has a mean particle size of about 0.07 microns; and the basis weight is about 30 $g/m^2$.

12. The smoking article of any of claims 9, 10 or 11 wherein the inherent porosity is between about 5 Coresta units and about 20 Coresta units.

13. The smoking article of any of claims 9, 10 or 11 wherein the inherent porosity is between about 20 Coresta units and about 35 Coresta units.

14. The smoking article of any of claims 9, 10 or 11 wherein the inherent porosity is between about 40 Coresta units and about 50 Coresta units.

15. The smoking article of any of claims 9, 10 or 11 wherein the paper wrapper further comprises a burn control additive, wherein the burn control additive level is between about 0.5% by weight and about 3% by weight.

16. The smoking article of claim 15 wherein the level of burn control additive is between about 1% by weight and about 1.7% by weight.

* * * * *